US008490830B2

(12) United States Patent
Magers

(10) Patent No.: US 8,490,830 B2
(45) Date of Patent: Jul. 23, 2013

(54) AIR COLLECTING AND EXPELLING AMUSEMENT DEVICE

(75) Inventor: Ross K. Magers, Essex, MA (US)

(73) Assignee: Buttercup Group, Inc., Clearwater, FL (US)

( * ) Notice: Subject to any disclaimer, the term of this patent is extended or adjusted under 35 U.S.C. 154(b) by 169 days.

(21) Appl. No.: 12/958,856

(22) Filed: Dec. 2, 2010

(65) Prior Publication Data

US 2012/0138633 A1 Jun. 7, 2012

(51) Int. Cl.
*A63H 3/18* (2006.01)

(52) U.S. Cl.
USPC ..... 222/79; 222/3; 222/212; 222/214; 222/630; 222/633; 124/70

(58) Field of Classification Search
USPC ..... 222/3, 79, 630–633, 192, 206, 212–215; 124/55–56, 73, 70–71; 446/197, 71–72; 472/134
See application file for complete search history.

(56) References Cited

U.S. PATENT DOCUMENTS 1,309,321 A * 7/1919 Fairweather ..... 124/69
1,328,866 A * 1/1920 Yeatter ..... 222/400.8
1,679,104 A * 7/1928 Trautman ..... 222/209
1,852,685 A * 4/1932 Tremblay ..... 222/633
2,159,894 A * 5/1939 Hines ..... 239/362
2,409,653 A * 10/1946 Amdur ..... 124/63
2,599,888 A * 6/1952 Beezley et al. ..... 446/21
2,802,298 A * 8/1957 Larin ..... 446/21
2,975,779 A * 3/1961 Pope ..... 124/64
3,010,614 A * 11/1961 Udy ..... 222/204
3,733,736 A * 5/1973 Glessner, Sr. ..... 446/18
3,733,738 A * 5/1973 Kramer ..... 446/267
4,043,341 A * 8/1977 Tromovitch ..... 606/22
4,872,802 A * 10/1989 Abbe ..... 414/416.09
5,042,819 A * 8/1991 LaFata ..... 273/349
5,471,968 A * 12/1995 Lee ..... 124/64
7,140,522 B2 * 11/2006 Kress ..... 222/633
7,455,248 B2 * 11/2008 Kablik et al. ..... 239/654

* cited by examiner

*Primary Examiner* — Frederick C Nicolas
(74) *Attorney, Agent, or Firm* — Maxley Law Offices; Stephen Lewellyn

(57) ABSTRACT

An amusement device for collecting and storing a quantity of air/gas from a selected source and expelling the stored air/gas as desired includes a collapsible bladder having an enclosed interior volume. The bladder being biased against collapse such that the bladder is expanded until being squeezed and such that the bladder once again expands when no longer being squeezed. The bladder including first and second openings into the enclosed interior volume. A first one-way valve is disposed across the first opening and configured to permit the flow of air into the enclosed interior volume through the first opening. A second one-way valve is disposed across second opening and configured to permit the flow of air out of the enclosed interior volume through the second opening. The device further includes a shallow dish member having an air collection space, wherein air that is disposed within the enclosed interior volume is expelled from the enclosed interior volume through the second opening upon squeezing the bladder and air disposed within the air collection space is drawn into the enclosed interior volume through the first opening upon expansion of the bladder.

1 Claim, 2 Drawing Sheets

FIG. 1
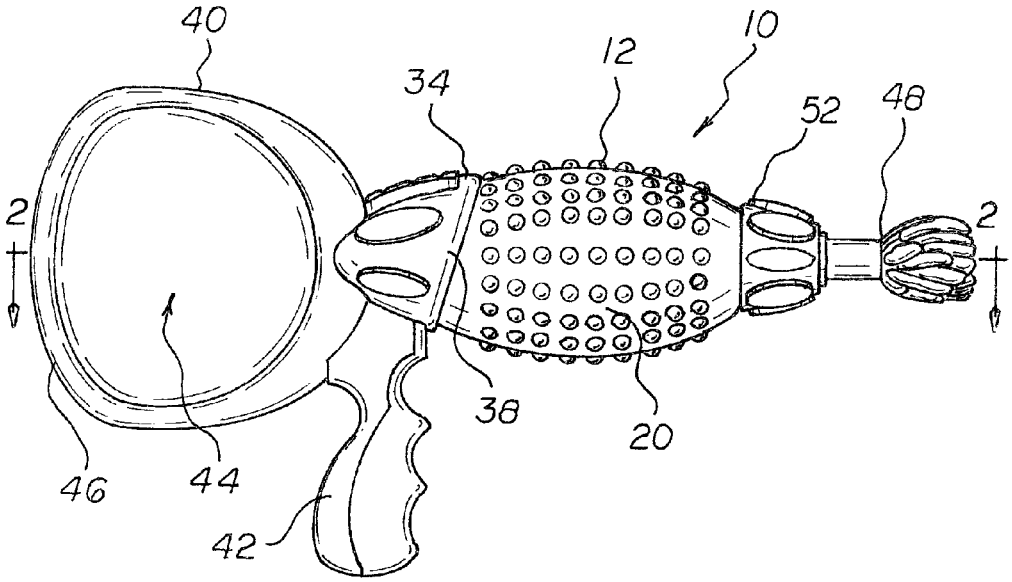
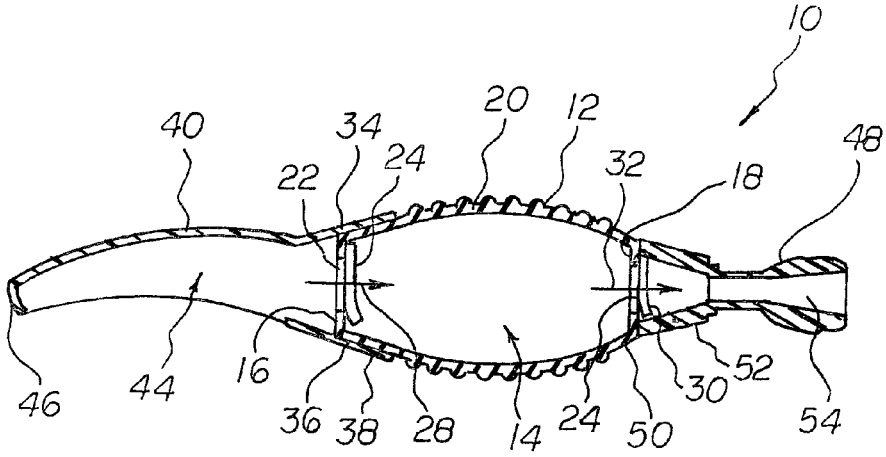
FIG. 2

AIR COLLECTING AND EXPELLING AMUSEMENT DEVICE

FIELD OF THE INVENTION

The present invention relates generally to amusement devices and more particularly, relating to an air collecting and expelling amusement device in the general form of a toy air gun.

BACKGROUND OF THE INVENTION

Amusement devices such as toy water guns that permit a user to fill a compartment of the toy water gun with water, which is then expelled through the operation of a trigger pump mechanism are known. Amusement devices including a canister of compressed air and a trigger mechanism that upon actuation releases the air through a noise maker are also known. Further, amusement devices including a flexible and flaccid pouch that may be inflated by a user exhaling into the pouch through a valve and which may be deflated by compressing the pouch to generate a noise are also known. While these existing amusement devices fulfill their respective objectives, a need remains for an amusement device that allows a user to collect and fill a compartment with a desired source of air/gas and to expel the collected air/gas when desired.

SUMMARY OF THE INVENTION

Embodiments of the present invention provide an amusement device for collecting and expelling air including a non-flaccid air bladder.

Embodiments of the present invention provide an amusement device for collecting and expelling air including a shallow-dish shaped air collection space.

Embodiments of the present invention provide an amusement device for collecting and expelling air in the form of a toy gun.

Embodiments of the present invention provide an amusement device for collecting and expelling air that is of a simple construction and inexpensive to produce.

To achieve these and other advantages, in general, in one aspect, an amusement device for collecting and expelling air includes a collapsible bladder having an enclosed interior volume. The bladder being biased against collapse such that the bladder is expanded until being squeezed and such that the bladder once again expands when no longer being squeezed. The bladder including first and second openings into the enclosed interior volume. A first one-way valve is disposed across the first opening and configured to permit the flow of air into the enclosed interior volume through the first opening. A second one-way valve is disposed across second opening and configured to permit the flow of air out of the enclosed interior volume through the second opening. The device further includes a shallow dish member having an air collection space, wherein air that is disposed within the enclosed interior volume is expelled from the enclosed interior volume through the second opening upon squeezing the bladder and air disposed within the air collection space is drawn into the enclosed interior volume through the first opening upon expansion of the bladder.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings:

FIG. 1 is a side view of an amusement device for collecting and expelling air constructed in accordance with the principles of the present invention;

FIG. 2 is a cross-sectional view of the device of FIG. 1 taken along line 2-2 in FIG. 2 and diagrammatically illustrating interior components of the device.

DETAILED DESCRIPTION OF THE INVENTION

Figure 3:
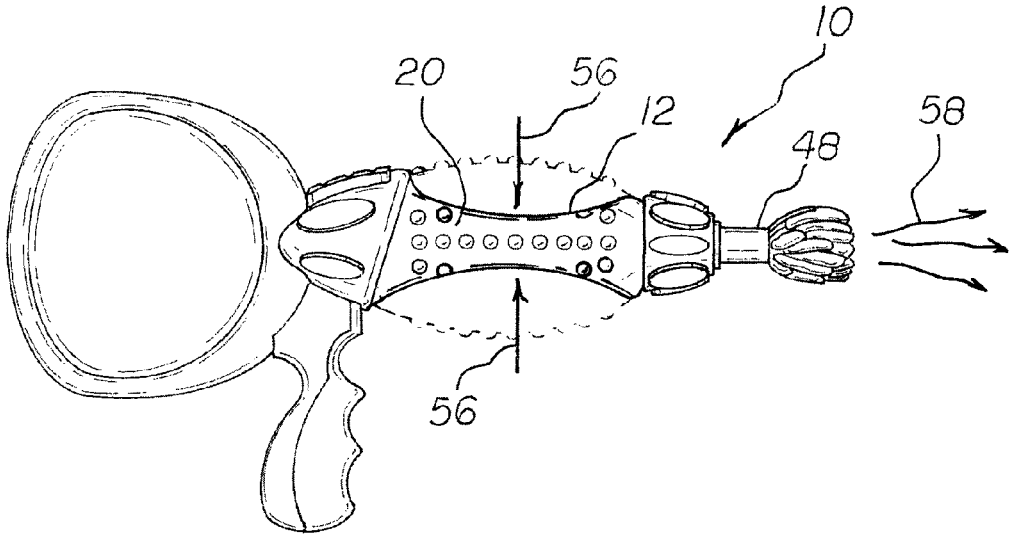
FIG. 3 is an exemplary in-use view of the device illustrating the air bladder being compressed and expelling air from the air bladder.

Referring to FIGS. 1 through 4 of the drawings, reference numeral 10 generally designates an air collecting and expelling amusement device of the present invention. Device 10 comprises an oblong-shaped air bladder 12 having an interior volume 14, opposite end walls 16 and 18 and a sidewall 20 connected to and extending between the end walls. End walls 16 and 18 and sidewall 20 collectively define and enclose the interior volume 14. End wall 16 includes an opening 22 therethrough and into the interior volume 14. End wall 18 includes an opening 24 therethrough and into the interior volume 14.

The bladder 12 is constructed such that its natural form takes on an expanded state (FIGS. 1-3), but is temporarily collapsed when squeezed (FIG. 4), for example by a users hand. After being squeezed the bladder 12 expands and once again returns to its natural expanded state. In an embodiment, sidewall 20 may be constructed of a resilient material that biases the bladder into the natural expanded state and resists collapse of the bladder. A skilled artisan will readily appreciate bladder 12 may be biased into the expanded state by other means. As a non-limiting example, a spring element could be provided in engagement with the sidewall 20 to expand the bladder 12.

A one-way valve 26 is disposed across opening 22 and is operable to only permit air to flow through opening 22 in a direction into the interior volume 14 as indicated by arrow 28. A second one-way valve 30 is disposed across opening 24 and is operable to only permit air to flow through opening 24 in a direction out of the interior volume 14 as indicated by arrow 32. Specifically, valves 26 and 30 operate such that when the bladder 12 is collapsed, air within the interior volume 14 is expelled through opening 24. After being squeezed, and during expansion of the bladder 12, air is drawn into the interior volume 14 through opening 22. This operation, will be further discussed below.

The device 10 further comprises a grip body 34 that is constructed of a rigid material and which is attached to the bladder 12 at an end 36 thereof Grip body 34 includes a connecting portion 38 which connects to the bladder 12, a shallow dish member 40, and a pistol grip 42. The shallow dish member 40 includes an air collection space 44 that is defined by a circumferential sidewall 46 thereof The air collection space 44 is in fluidic communication with opening 22 such that air within the air collection space may be drawn through opening 22. The shallow dish member 40 is designed to be positioned by the user to entrap a quantity of gas or air from a source as desired. The broad and shallow shape of the dish member 40 is particularly well suited be positioned on or about a surface from which a gas or air is expelled to collect and trap the gas or air within the air collection space 44, thereby permitting the user a period of time to collect the gas or air as explained below.

The device 10 further comprises a barrel body 48 that is constructed of a rigid material and which is attached to the bladder 12 at an end 50 opposite of end 36. Barrel body 48 includes a connecting portion 52 which connects to the bladder 12 and a bore 54 which extends through the barrel body. Bore 54 is in alignment with opening 24 to receive air expelled from the bladder 12 through opening 24.

In operation it can now be understood, as best seen in FIG. 3, a user squeezes opposing surfaces of sidewall 20, as indicated by arrows 56, to collapse the bladder 12 from the expanded state (shown in broken line) to a collapsed state. This results in the interior volume 14 being reduced and expelling air 58 from within the interior volume through valve 30 and opening 24 and into and through bore 54 where it is finally ejected into the ambient space. The rate and force at which the air 58 is ejected can be controlled by the speed and force a user squeezes the bladder 12.

Figure 4:
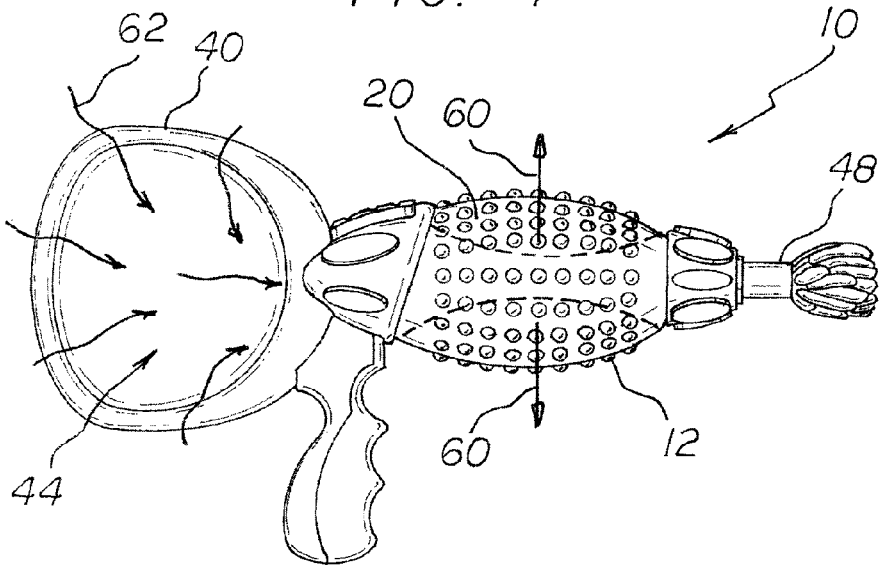
FIG. 4 is an exemplary in-use view of the device illustrating the air bladder expanding and drawing in air into the air bladder from the shallow-dish member.

As best seen in FIG. 4, once the bladder 12 is released, the bladder expands from biasing forces, as indicated by arrows 60, from the collapsed state (shown in broken line) to the expanded state. This results in the interior volume 14 being enlarged and creating a vacuum within the interior volume causing air 62 located within the air collection space 44 and the area surrounding the shallow dish member 40 to be drawn into the interior volume through valve 28 and opening 22. The collected air can then be expelled by squeezing the bladder 12. The squeezing and releasing of the bladder 12 is repeated as desired by the user.

While is it not depicted herein, a skilled artisan will appreciate an air powered noise maker may be disposed at any suitable location in the flow of air being expelled from the bladder 12 to generate a noise as the air is expelled.

A number of embodiments of the present invention have been described. Nevertheless, it will be understood that various modifications may be made without departing from the spirit and scope of the invention. Accordingly, other embodiments are within the scope of the following claims.

What is claimed is:

1. An air collecting and expelling amusement device, comprising:

a collapsible bladder having an enclosed interior volume, said bladder being elongated and biased against collapse such that said bladder is expanded until being squeezed and such that said bladder once again expands when no longer being squeezed, said bladder including first and second openings into said enclosed interior volume;

a first one-way valve disposed across said first opening and configured to permit the flow of air into said enclosed interior volume through said first opening;

a second one-way valve disposed across second opening and configured to permit the flow of air out of said enclosed interior volume through said second opening;

a grip body connected to one end of said bladder and extending rearwardly from said bladder and comprising a shallow dish member and a pistol grip for grasping by a user;

said shallow dish member having an air collection space defined by a circumferential sidewall of said dish member and being open such that said dish member is positionable against a surface to collect and trap air expelled from the surface in said air collection space upon which the dish member is positioned, said air collection space in fluidic communication with said first opening;

a barrel body connected to a second end of said bladder opposite of said grip body and extending forwardly from said bladder and comprising a through bore fluidically connected to said second opening;

said grip body, said bladder, and said barrel body collectively defining a pistol shape with said bladder extending between said grip body and said barrel body and being graspable by a user to squeeze said bladder; and wherein air that is disposed within said enclosed interior volume is expelled from said enclosed interior volume through said second opening and said through bore upon squeezing said bladder and air disposed within said air collection space is drawn into said enclosed interior volume through said first opening upon expansion of said bladder.

* * * * *